US010062475B1

(12) United States Patent
Bigbee, Jr. et al.

(10) Patent No.: US 10,062,475 B1
(45) **Date of Patent: *Aug. 28, 2018**

(54) SYSTEM, COMPOSITION AND METHOD OF APPLICATION OF SAME FOR REDUCING THE COEFFICIENT OF FRICTION AND REQUIRED PULLING FORCE DURING INSTALLATION OF WIRE OR CABLE

(71) Applicant: ENCORE WIRE CORPORATION, McKinney, TX (US)

(72) Inventors: William T. Bigbee, Jr., Melissa, TX (US); Sheri H. Dahlke, West Lakeland, MN (US); Ronald A. Raedeke, Marine on St. Croix, MN (US); Jason Drew Gillen, Anna, TX (US); Melvin Glenn Debord, Van Alstyne, TX (US)

(73) Assignee: Encore Wire Corporation, McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/251,975

(22) Filed: Aug. 30, 2016

Related U.S. Application Data

(63) Continuation of application No. 14/927,277, filed on Oct. 29, 2015, now Pat. No. 9,458,404, which is a (Continued)

(51) Int. Cl.
*H01B 7/02* (2006.01)
*C10M 145/28* (2006.01)
(Continued)

(52) U.S. Cl.
CPC ..... *H01B 7/02* (2013.01); *C10M 145/28* (2013.01); *C10M 169/04* (2013.01); (Continued)

(58) Field of Classification Search
CPC ..... C10M 125/26; C10M 145/14; C10M 145/28; C10M 155/02; C10M 161/00; (Continued)

(56) References Cited

U.S. PATENT DOCUMENTS 2,276,437 A 3/1942 Vaala
2,685,707 A 8/1954 Llewellyn et al.
(Continued)

FOREIGN PATENT DOCUMENTS

CA 2726607 A1 12/2009
CN 202917210 U 5/2013
(Continued)

OTHER PUBLICATIONS

American Polywater Corporation, "Laboratory Report—American Polywater Spurt Spray Lubricant Test Compared to Polywater J and NN", Aug. 9, 2005, 6 pages.
(Continued)

*Primary Examiner* — Taiwo Oladapo
(74) *Attorney, Agent, or Firm* — Warren Rhoades LLP

(57) ABSTRACT

A composition and method for reducing the coefficient of friction and required pulling force of a wire or cable are provided. A composition of aqueous emulsion is provided that is environmentally friendly, halogen free and solvent free. The composition is compatible with various types of insulating materials and may be applied after the wire or cable is cooled and also by spraying or submerging the wire or cable in a bath. The composition contains lubricating agents that provide lower coefficient of friction for wire or cable installation and continuous wire or cable surface lubrication thereafter.

20 Claims, 3 Drawing Sheets

Related U.S. Application Data continuation of application No. 14/150,246, filed on Jan. 8, 2014, now Pat. No. 9,200,234, which is a continuation of application No. 12/909,501, filed on Oct. 21, 2010, now Pat. No. 8,658,576.

(60) Provisional application No. 61/253,728, filed on Oct. 21, 2009.

(51) Int. Cl.
*C10M 169/04* (2006.01)
*C10M 173/00* (2006.01)
*H01B 1/02* (2006.01)

(52) U.S. Cl.
CPC ..... *C10M 169/044* (2013.01); *C10M 173/00* (2013.01); *H01B 1/023* (2013.01); *H01B 1/026* (2013.01); *C10M 2201/02* (2013.01); *C10M 2201/10* (2013.01); *C10M 2205/16* (2013.01); *C10M 2207/10* (2013.01); *C10M 2209/084* (2013.01); *C10M 2209/104* (2013.01); *C10M 2213/02* (2013.01); *C10M 2217/024* (2013.01); *C10M 2229/02* (2013.01); *C10M 2229/041* (2013.01); *C10N 2230/06* (2013.01); *C10N 2240/50* (2013.01); *C10N 2250/02* (2013.01)

(58) Field of Classification Search
CPC ..... C10M 169/044; C10M 173/00; C10M 2201/02; C10M 2201/10; C10M 2205/022; C10M 2209/084; C10M 2229/04; C10M 2290/00; C10M 169/04; C10M 2229/02; C10M 2207/10; C10M 2209/104; C10M 2217/024; C10M 2213/02; C10M 2205/16; C10M 2229/041; C10N 2230/06; C10N 2240/50; C10N 2250/02; H01B 7/02; H01B 1/023; H01B 1/026
See application file for complete search history.

(56) References Cited

U.S. PATENT DOCUMENTS 2,930,838 A 3/1960 Chuzallet et al.
3,064,073 A 11/1962 Downing et al.
3,108,981 A 10/1963 Clark et al.
3,191,005 A 6/1965 Cox, II
3,258,031 A 6/1966 French
3,333,037 A 7/1967 Humphrey et al.
3,378,628 A 4/1968 Garner
3,433,884 A 3/1969 Cogelia et al.
3,668,175 A 6/1972 Sattler
3,747,428 A 7/1973 Waner et al.
3,775,175 A 11/1973 Merian
3,822,875 A 7/1974 Schmedemann
3,849,221 A 11/1974 Middleton
3,852,875 A 12/1974 McAmis et al.
3,868,436 A 2/1975 Ootsuji et al.
3,877,142 A 4/1975 Hamano et al.
3,885,286 A 5/1975 Hill
3,936,572 A 2/1976 MacKenzie, Jr. et al.
4,002,797 A 1/1977 Hacker et al.
4,043,851 A 8/1977 Holladay et al.
4,057,956 A 11/1977 Tolle
4,099,425 A 7/1978 Moore
4,100,245 A 7/1978 Horikawa et al.
4,137,623 A 2/1979 Taylor
4,273,806 A 6/1981 Stechler
4,273,829 A 6/1981 Perreault
4,274,509 A 6/1981 Thomson et al.
4,275,096 A 6/1981 Taylor
4,299,256 A 11/1981 Bacehowski et al.
4,356,139 A 10/1982 Rowland et al.
4,360,492 A 11/1982 Rowland et al.
4,414,917 A 11/1983 Bentley et al.
4,416,380 A 11/1983 Flum
4,447,569 A 5/1984 Brecker et al.
4,449,290 A 5/1984 Saunders et al.
4,454,949 A 6/1984 Flum
4,461,712 A 7/1984 Jonnes
4,475,629 A 10/1984 Jonnes
4,522,733 A * 6/1985 Jonnes ..... C10M 173/02 508/507
4,547,246 A 10/1985 Viriyayuthakorn et al.
4,565,725 A 1/1986 Spamer et al.
4,568,420 A 2/1986 Nonni
4,569,420 A 2/1986 Pickett et al.
4,605,818 A 8/1986 Arroyo et al.
4,650,073 A * 3/1987 Young ..... B65D 85/04 206/389
4,673,516 A 6/1987 Berry
4,684,214 A 8/1987 Goldmann et al.
4,693,936 A 9/1987 McGregor et al.
4,749,059 A 6/1988 Jonnes et al.
4,751,261 A 6/1988 Miyata et al.
4,761,445 A 8/1988 Chiba
4,773,954 A 9/1988 Starnes, Jr.
4,781,847 A 11/1988 Weitz
4,806,425 A 2/1989 Chu-Ba
4,868,054 A 9/1989 Kartheiser
4,902,749 A 2/1990 Akkapeddi et al.
4,937,142 A 6/1990 Ogushi et al.
4,940,504 A 7/1990 Starnes, Jr.
4,952,021 A 8/1990 Aoki et al.
4,965,249 A 10/1990 De With et al.
5,036,121 A 7/1991 Coaker et al.
5,055,522 A 10/1991 Ikeda et al.
5,063,272 A 11/1991 Sasse
5,074,640 A 12/1991 Hardin et al.
5,106,701 A 4/1992 Kurosaka et al.
5,130,184 A 7/1992 Ellis
5,156,715 A 10/1992 Starnes, Jr.
5,182,784 A * 1/1993 Hager ..... C03C 25/26 385/102
5,190,679 A * 3/1993 McDonald ..... C10M 173/02 508/161
5,213,644 A 5/1993 Phillips et al.
5,217,795 A 6/1993 Sasse et al.
5,225,635 A 7/1993 Wake et al.
5,227,080 A 7/1993 Berry
5,252,676 A 10/1993 Suyama et al.
5,324,588 A 6/1994 Rinehart et al.
5,326,638 A 7/1994 Mottine, Jr. et al.
5,346,383 A 9/1994 Starnes, Jr.
5,356,710 A 10/1994 Rinehart
5,383,799 A 1/1995 Fladung
5,416,269 A 5/1995 Kemp et al.
5,451,718 A 9/1995 Dixon
5,460,885 A 10/1995 Chu-Ba
5,492,760 A 2/1996 Sarma et al.
5,505,900 A 4/1996 Suwanda et al.
5,519,172 A 5/1996 Spencer et al.
5,561,730 A 10/1996 Lochkovic et al.
5,565,242 A 10/1996 Buttrick, Jr. et al.
5,614,288 A 3/1997 Bustos
5,614,482 A 3/1997 Baker et al.
5,654,095 A 8/1997 Yin et al.
5,656,371 A 8/1997 Kawahigashi et al.
5,660,932 A 8/1997 Durston
5,707,468 A 1/1998 Arnold et al.
5,707,770 A 1/1998 Tanikawa et al.
5,708,084 A 1/1998 Hauenstein et al.
5,733,823 A 3/1998 Sugioka et al.
5,735,528 A 4/1998 Olsson
5,741,858 A 4/1998 Brann et al.
5,753,861 A 5/1998 Hansen et al.
5,759,926 A 6/1998 Pike et al.
5,795,652 A 8/1998 Bell et al.
5,846,355 A 12/1998 Spencer et al.
5,852,116 A 12/1998 Cree et al.
5,856,405 A 1/1999 Hofmann

(56) References Cited

U.S. PATENT DOCUMENTS 5,886,072 A 3/1999 Linsky et al.
5,912,436 A 6/1999 Sanchez et al.
5,925,601 A 7/1999 McSherry et al.
5,965,263 A 10/1999 Tatematsu et al.
5,981,008 A 11/1999 Hofmann
6,039,024 A 3/2000 Carlson et al.
6,054,224 A 4/2000 Nagai et al.
6,057,018 A 5/2000 Schmidt
6,060,162 A 5/2000 Yin et al.
6,060,638 A 5/2000 Paul et al.
6,063,496 A 5/2000 Jozokos et al.
6,064,073 A 5/2000 Hoogenraad
6,080,489 A 6/2000 Mehta
6,101,804 A 8/2000 Gentry et al.
6,106,741 A 8/2000 Heimann et al.
6,114,036 A 9/2000 Rinehart et al.
6,114,632 A 9/2000 Planas, Sr. et al.
6,137,058 A 10/2000 Moe et al.
6,146,699 A 11/2000 Bonicel et al.
6,157,874 A 12/2000 Cooley et al.
6,159,617 A 12/2000 Foster et al.
6,160,940 A 12/2000 Summers et al.
6,184,473 B1 2/2001 Reece et al.
6,188,026 B1 * 2/2001 Cope ..... H01B 7/1885 174/120 C
6,214,462 B1 4/2001 Andre et al.
6,222,132 B1 4/2001 Higashiura et al.
6,228,495 B1 5/2001 Lupia et al.
6,242,097 B1 6/2001 Nishiguchi et al.
6,270,849 B1 8/2001 Popoola et al.
6,281,431 B1 8/2001 Cumley
6,319,604 B1 11/2001 Xu
6,327,841 B1 12/2001 Bertini et al.
6,329,055 B1 12/2001 Higashiura et al.
6,347,561 B2 2/2002 Uneme et al.
6,359,231 B2 3/2002 Reece et al.
6,395,989 B2 5/2002 Lecoeuvre et al.
6,416,813 B1 7/2002 Valls Prats
6,418,704 B2 7/2002 Bertini et al.
6,424,768 B1 7/2002 Booth et al.
6,430,913 B1 8/2002 Gentry et al.
6,437,249 B1 8/2002 Higashiura et al.
6,461,730 B1 10/2002 Bachmann et al.
6,474,057 B2 11/2002 Bertini et al.
6,495,756 B1 12/2002 Burke et al.
6,530,205 B1 3/2003 Gentry et al.
6,534,717 B2 3/2003 Suzuki et al.
6,565,242 B2 5/2003 Dai
6,596,945 B1 7/2003 Hughey et al.
6,640,533 B2 11/2003 Bertini et al.
6,646,205 B2 11/2003 Hase et al.
6,728,206 B1 4/2004 Carlson
6,734,361 B2 5/2004 Mesaki et al.
6,766,091 B2 7/2004 Beuth et al.
6,810,188 B1 10/2004 Suzuki et al.
6,850,681 B2 2/2005 Lepont et al.
6,903,264 B2 6/2005 Watanabe et al.
6,906,258 B2 6/2005 Hirai et al.
6,912,222 B1 6/2005 Wheeler et al.
6,977,280 B2 12/2005 Lee et al.
6,997,280 B2 2/2006 Minoura et al.
6,997,999 B2 2/2006 Houston et al.
6,998,536 B2 2/2006 Barusseau et al.
7,053,308 B2 5/2006 Prats
7,087,843 B2 8/2006 Ishii et al.
7,129,415 B1 10/2006 Bates et al.
7,135,524 B2 11/2006 Breitscheidel et al.
7,136,556 B2 11/2006 Brown et al.
7,144,952 B1 12/2006 Court et al.
7,158,707 B2 1/2007 Will et al.
7,208,684 B2 4/2007 Fetterolf, Sr. et al.
7,247,266 B2 7/2007 Bolcar
7,267,571 B1 9/2007 Twigg et al.
7,302,143 B2 11/2007 Ginocchio et al.
7,411,129 B2 8/2008 Kummer et al.
7,485,810 B2 2/2009 Bates et al.
7,490,144 B2 2/2009 Carlson et al.
7,491,889 B2 2/2009 Dinkelmeyer et al.
7,549,474 B2 6/2009 Valenziano et al.
7,555,542 B1 6/2009 Ayers et al.
7,557,301 B2 7/2009 Kummer et al.
7,642,451 B2 1/2010 Bonn
7,678,311 B2 3/2010 Bolcar
7,749,024 B2 7/2010 Chambers et al.
7,776,441 B2 8/2010 Mhetar et al.
7,934,311 B2 5/2011 Varkey
8,043,119 B2 10/2011 Kummer et al.
8,088,997 B2 1/2012 Picard et al.
8,382,518 B2 2/2013 Chambers et al.
8,616,918 B2 12/2013 Chambers et al.
8,658,576 B1 2/2014 Bigbee, Jr. et al.
8,701,277 B2 4/2014 Kummer et al.
9,200,234 B1 * 12/2015 Bigbee, Jr. ..... C10M 169/044
9,458,404 B1 * 10/2016 Bigbee, Jr. ..... C10M 169/044
2002/0002221 A1 1/2002 Lee
2002/0139559 A1 * 10/2002 Valls Prats ..... H01B 13/145 174/110 FC
2003/0195279 A1 10/2003 Shah et al.
2004/0001682 A1 1/2004 Beuth et al.
2004/0045735 A1 * 3/2004 Varkey ..... H01B 3/441 174/120 R
2004/0254299 A1 12/2004 Lee et al.
2005/0019353 A1 1/2005 Prinz et al.
2005/0023029 A1 2/2005 Mammeri et al.
2005/0107493 A1 5/2005 Amirzadeh-Asl
2005/0180725 A1 8/2005 Carlson et al.
2005/0180726 A1 8/2005 Carlson et al.
2006/0065428 A1 3/2006 Kummer et al.
2006/0065430 A1 3/2006 Kummer et al.
2006/0068085 A1 3/2006 Reece et al.
2006/0068086 A1 3/2006 Reece et al.
2006/0088657 A1 4/2006 Reece et al.
2006/0151196 A1 7/2006 Kummer et al.
2006/0157303 A1 7/2006 Reece et al.
2006/0167158 A1 7/2006 Yagi et al.
2006/0191621 A1 8/2006 Kummer et al.
2006/0249298 A1 11/2006 Reece et al.
2006/0249299 A1 11/2006 Kummer et al.
2006/0251802 A1 11/2006 Kummer et al.
2007/0098340 A1 5/2007 Lee et al.
2007/0207186 A1 9/2007 Scanlon et al.
2008/0066946 A1 3/2008 Kummer et al.
2008/0244925 A1 10/2008 Shin
2008/0268218 A1 10/2008 Lee
2009/0250238 A1 10/2009 Picard et al.
2009/0250239 A1 10/2009 Picard et al.
2010/0044071 A1 2/2010 Murao et al.
2010/0105583 A1 4/2010 Garmier
2010/0230134 A1 9/2010 Chambers et al.
2010/0236811 A1 9/2010 Sasse et al.
2010/0255186 A1 10/2010 Montes et al.
2010/0285968 A1 11/2010 Gregory
2011/0034357 A1 2/2011 Kawata et al.
2011/0144244 A1 6/2011 Lee
2011/0290528 A1 12/2011 Honda et al.
2012/0012362 A1 1/2012 Kim et al.
2013/0168128 A1 7/2013 Lopez-Gonzalez

FOREIGN PATENT DOCUMENTS

EP 0283132 A2 9/1988
EP 0364717 A1 4/1990
EP 0544411 A1 6/1993
EP 1524294 A1 4/2005
FR 2674364 A1 9/1992
IN 9500996 I4 3/2010
JP 61133506 A 6/1986
JP 61133507 6/1986
JP 01110013 4/1989
JP 01144504 6/1989
JP 01166410 A 6/1989
JP 01307110 12/1989
JP 05266720 10/1993
JP 06057145 3/1994

(56) References Cited

FOREIGN PATENT DOCUMENTS

| | | | |
|---|---|---|---|
| JP | 9045143 | A | 2/1997 |
| JP | 09251811 | | 9/1997 |
| JP | 1012051 | | 1/1998 |
| JP | 1086207 | A | 4/1998 |
| JP | 2001264601 | A | 9/2001 |
| JP | 2002231065 | | 8/2002 |
| JP | 2003323820 | | 11/2003 |
| WO | 198900763 | A1 | 1/1989 |
| WO | 1991008262 | A2 | 6/1991 |
| WO | 1995012885 | A1 | 5/1995 |
| WO | 2000040653 | A1 | 7/2000 |
| WO | 2001081969 | A1 | 11/2001 |
| WO | 2001090230 | A1 | 11/2001 |
| WO | 2002043391 | A1 | 5/2002 |
| WO | 2003086731 | A1 | 10/2003 |
| WO | 2005042226 | A1 | 5/2005 |
| WO | 2006015345 | A2 | 2/2006 |
| WO | 2006016895 | A1 | 2/2006 |
| WO | 2006016896 | A1 | 2/2006 |
| WO | 2006118702 | A2 | 11/2006 |
| WO | 2006127711 | A2 | 11/2006 |
| WO | 2007081372 | A1 | 7/2007 |
| WO | 2007084745 | A2 | 7/2007 |
| WO | 2009126613 | A1 | 10/2009 |
| WO | 2009126619 | A1 | 10/2009 |
| WO | 2010107932 | A1 | 9/2010 |
| WO | 2010113004 | A2 | 10/2010 |

OTHER PUBLICATIONS

American Polywater Corporation, "Polywater J Specification", Aug. 2010, 4 pages.
American Polywater Corporation, "Polywater SPY Cable Lubricant—Technical Specification", May 2008, 4 pages.
American Polywater Corporation, "Polywater SPY Lubricant—Technical Report", Feb. 26, 2008, 4 pages.
Axel Plastics Research Laboratories, Inc., Product Data Sheet re "Mold Wiz. Int-40DHT" (Approx. 2001) (1 p).
CSA Standards Update Service, "Thermoplastic-Insulated Wires and Cables", UL 83, Thirteenth Edition, Nov. 15, 2003, 186 pages.
DeCoste, "Friction of Vinyl Chloride Plastics", SPE Journal, vol. 25, Oct. 1969, pp. 67-71.
Domininghaus, "Les Matieres plastiques les plus usuelles," Informations Chimie No. 158, pp. 179-194, 1976.
Dow Corning article "Siloxane additive minimizes friction in fibre optic cable conduit", 2000 (2 pp) (http://www.dowcorning.com).
Dow Corning Product Information sheet re Dow Corning MB40-006 composition. 1997-2005(1 p) (http://www.downcorning.com).
Dow Corning Product Information sheet re Dow Corning MB50-001 composition. Jan. 15, 2001 (6 pp) (http://www.dowcorning.com).
Dow Corning Material Safety Data Sheet: re Dow Corning MB50-008 composition, Mar. 4, 2008 (1 pp) (http://www.dowcorning.com).
Dow Corning Product Information sheet re Dow Corning MB50-321 composition, Jan. 15, 2001 (2pp) (http://www.dowcorning.com).
Dow Corning Product Information sheet re Dow Corning MB50-002 composition, 1997-2014 (4 pp) (http://www.dowcorning.com).
Dow Corning Product Information sheet re Dow Corning MB50-004 composition, Jan. 15, 2001 (4 pp) (http://www.dowcoming.com).
Dow Corning Product Information sheet re Dow Corning MB50-010 composition, Jan. 16, 2011 (2pp) (http://www.dowcorning.com).
Dow Corning Material Safety Data Sheet re Dow Corning MB50-011 composition, Mar. 4, 2008 (I p) (http://www.dowcorning.com).
Dow Corning Material Safety Data Sheet sheet re Dow Corning MB50-320 composition, Mar. 4, 2008 (I pp) (http://www.dowcorning.com).
Dow Corning Product information sheets re Dow Corning MB50-313 composition, Nov. 5, 2001 (4 pp) (http://www.dowcorning.com).
Dow Corning Product information sheets re Dow Corning M850-314 composition, Nov. 5, 2001 (4 pp) (http://www.dowcorning.com).
Dow Corning, "Dow Corning MB50-011 Masterbatch Material Safety Data Sheet Information", 1997-2001.
Dow Corning, "Dow Corning MB50-011 Masterbatch Product Information", Ultra-high Molecular Weight Siloxane Polymer Dispersed in Polymide 6, 1999, pp. 1-3.
European Patent Office, "Extended Search Report for Application No. 06739714.1", dated Nov. 12, 2009.
European Patent Office, Opposition to European Patent EP 1899988 and accompanying documentation, filed Oct. 22, 2013 (23 pages).
General Electric Company, Brochure entitled "GE Silicones-Fluids, Emulsions & Specialties", (2001) (19 pp).
Ideal Industries GmbH, "Yellow 77" Document, 2003, 1 page.
Trotignon et al., "Extrusion des Thermoplastiques", in "Matieres Plastiques", Editions Nathan, 1996, p. 148.
Underwriters Laboratories, Inc., Safety for Nonmetallic-Sheathed Cables, UL 719, 12th Edition, Feb. 9, 2006, pp. 1-42.
Wild, Frank, "The Effects of Silicone Polymer Additions on the Processing and Properties of an Isotactic Propylene Homopolymer", Sep. 1995, 102 pages.
Wiles, John, "Clarifying Confusing Cables", Home Power #66, Aug./Sep. 1998.

* cited by examiner

SYSTEM, COMPOSITION AND METHOD OF APPLICATION OF SAME FOR REDUCING THE COEFFICIENT OF FRICTION AND REQUIRED PULLING FORCE DURING INSTALLATION OF WIRE OR CABLE

CROSS-REFERENCE TO RELATED APPLICATIONS

This application is a continuation of U.S. patent application Ser. No. 14/927,277, filed Oct. 29, 2015, now issued as U.S. Pat. No. 9,458,404 on Oct. 4, 2016, which claims benefit of U.S. patent application Ser. No. 14/150,246, filed Jan. 8, 2014, now issued as U.S. Pat. No. 9,200,234 on Dec. 1, 2015, which claims benefit of U.S. patent application Ser. No. 12/909,501, filed on Oct. 21, 2010, now issued as U.S. Pat. No. 8,658,576 on Feb. 25, 2014, which claims priority to and benefit of U.S. Provisional Application Ser. No. 61/253,728, filed on Oct. 21, 2009, all of which are hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF INVENTION

1. Field of Invention

This invention relates to wire and cable. More specifically, it relates to a systems, composition and method for applying the composition to wire and cable for all applications requiring a reduction in coefficient of friction and pulling force required for installation.

2. Description of Related Art

A wire or cable generally consists of one or more internal conductors and an insulator that envelopes internal conductors. The insulator may be made of insulating materials such as polyvinyl chloride (PVC) or polyethylene (PE). During installation of these wires or cables, increased effort is required to pull the wires or cables through the conduit due to friction between the materials involved. This friction also may result in damage of the wire or cable during the installation process.

Currently, various methods are used to minimize the coefficient of friction on the surface of the wire or cable to reduce the amount of pulling force required. One method involves incorporating lubricating agents into the insulating material during the manufacturing process of the wire or cable, specifically, prior to cooling of the insulating material. However, this method often requires lubricating agents to be impregnated or infused into the insulating material at a high temperature, which adversely affects the chemical, physical, and electrical properties of the wire or cable. Another method involves hand application of lubricating agents by hand prior to installation of the wire or cable at a job site. But this method is time consuming, labor intensive, and requires additional material to be on the job site during cable installation.

Therefore, a need exists for a composition and method for reducing coefficient of friction in a wire or cable that does not require mixing, impregnation, or infusion into the insulating material and has minimal impact on the chemical properties of the surface material.

BRIEF SUMMARY OF THE INVENTION

A composition and method for reducing the coefficient of friction and required pulling force of a wire or cable are provided. A composition of aqueous emulsion is provided that is environmentally friendly, halogen free and solvent free. The composition is compatible with various types of insulating materials and may be applied after the wire or cable is cooled and also by spraying or submerging the wire or cable in a bath. The composition comprises lubricating agents that provide lower coefficient of friction for wire or cable installation and continuous wire or cable surface lubrication thereafter. A process for making a finished wire and cable having a reduced coefficient of friction and pulling force required during installation, the process comprising providing a payoff reel containing at least one internal conductor wire; supplying the internal conductor wire from the reel to an extruder; providing at least one extruder, wherein the least one extruders applies an insulating material over the internal conductor wire; providing a cooling device for lowering the temperature of the extruded insulating material and cooling the extruded insulating material in the cooling device; providing a lubrication application device; applying a lubricating composition onto the cooled insulting material with the lubrication application device, wherein the lubricating composition comprises polytetrafluoroethylene; about 93.20 weight % based on total weight, distilled (DI) water; about 1.38 weight % based on total weight, polyethylene glycol; about 1.29 weight % based on total weight, potassium neutralized vegetable fatty acid; about 1.99 weight % based on total weight, paraffin wax emulsion; about 1.88 weight % based on total weight, polydimethylsiloxane (PDMS) emulsion; about 0.01 weight % based on total weight, polyacrylamide polymer; about 0.08 weight % based on total weight, potassium salt of polyacrylic acid polymer; and about 0.16 weight % based on total weight, silicone-based antifoaming agent; and, reeling onto a storage reel the finished, cooled and lubricated, wire and cable product for storage and distribution.

BRIEF DESCRIPTION OF THE DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawings, in which.

DETAILED DESCRIPTION OF THE INVENTION

The present disclosure provides a composition and method for reducing the coefficient of friction and required pulling force of a wire or cable during installation. A composition of aqueous emulsion is provided that is environmentally friendly, halogen free and solvent free. The composition is compatible with various types of insulating materials including, but not limited to, polyvinyl chloride (PVC) and polyethylene (PE).

The composition includes lubricating agents having a viscosity that allows for various application methods, for example, by way of spraying over the wire or cable or submerging the wire or cable in a bath. In one embodiment, the viscosity of the composition is between about 1 and about 1000 cps at about 25 degrees Celsius and a pH level ranging between about 6.6 to about 10. This viscosity minimizes the dripping and flowing of the composition after it is applied to the wire or cable, thereby making it easier to apply during the manufacturing process.

Figure 1:
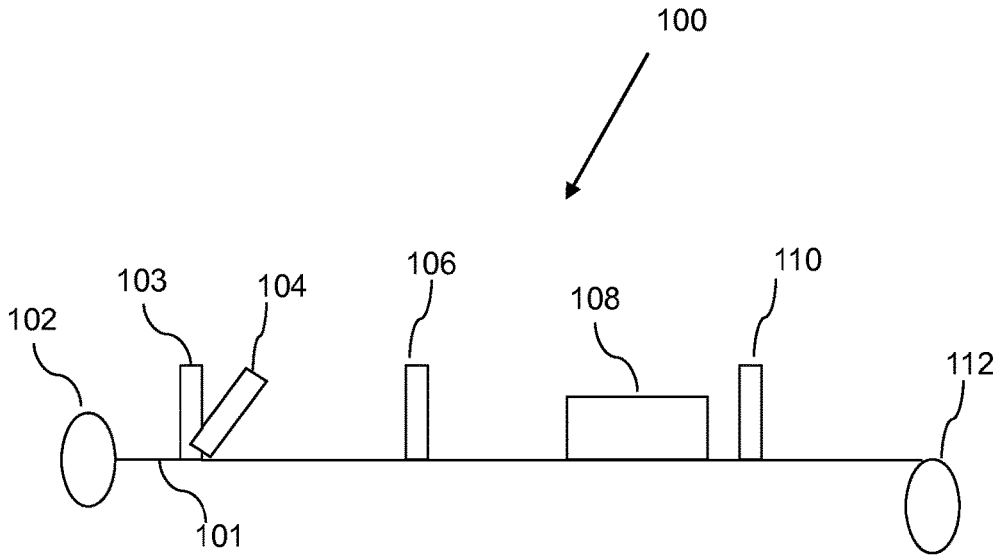
FIG. 1 is a diagram illustrating a system for application of a composition to reduce the coefficient of friction and required pulling force during installation of wire or cable in accordance with an embodiment of the present disclosure.

Referring to FIG. 1, a diagram illustrating system for applying a composition to reduce the coefficient of friction and required pulling force during installation of wire or cable is depicted in accordance with one embodiment of the present disclosure. In this embodiment, a standard payoff reel 102 to supply an internal conductor(s) 101, such as a copper or aluminum wire is provided in system 100. The standard payoff reel 102 supplies the internal conductor(s) 101 to an extruder 103 to apply an insulating material over the internal conductor(s) 101. Extruder 103 may be a single extruder head, a plurality of extruders, a cross head, a co-extrusion head or any combination thereof. The insulating material may be thermoset, thermoplastic, elastomeric, polymeric dielectric or a semiconductor compound or any combination thereof.

A first optional extruder 104 is also provided in system 100 to apply an additional layer of insulating material over the internal conductor(s) 101 that may comprise a thermoset, thermoplastic, elastomeric, polymeric dielectric or a semiconductor compound or any combination thereof. The first optional extruder 104 may also function in the system 100 to apply a further additional layer of material, such as, but not limited to Nylon, over the wire or cable to form an outer jacket.

A second optional extruder 106 may also be provided in system 100 to apply a further additional layer of thermoplastic or thermoset material thermoset, thermoplastic, elastomeric, polymeric dielectric or a semiconductor compound or any combination thereof such as, but not limited to, Nylon over the insulated wire or cable to form an outer jacket. Alternatively, second optional extruder 106 may be provided to apply additional insulating material over the insulated wire or cable to form an additional insulating layer. For example, second optional extruder 106 may be provided to apply an insulating material, such as PVC, over the insulated wire or cable. It is contemplated by the present invention that even further additional optional extruders may be provided for additional material application to the wire and cable.

After the insulating material is applied, the insulated wire or cable is supplied to a cooling device 108 for cooling the applied insulating material over the wire or cable. In one embodiment, the cooling device 108 may be a water trough or similar device that contains a cooling material. The cooling device 108 functions to cool and lower the temperature of the insulating material over the wire or cable as it departs extruder 103 and/or first optional extruder 104 and/or second optional extruder 106 and enters the cooling device 108 by removing latent heat caused by extrusion in extruder 104 or the first optional extruder 104 or the second optional extruder 106. The cooling of insulating material provides a more stable polymeric state for later processing. In one embodiment, the insulating material is cooled to an ambient temperature, such as a temperature of less than 85 degrees Celsius.

Once the insulated wire or cable is cooled, an application device 110 is provided in system 100 to apply the composition with lubricating agents over the cooled and insulated wire or cable. Because the composition with lubricating agents may be used between about −5 degrees and about 50 degrees Celsius, it may be applied after the wire or cable is cooled instead of the need for impregnating, infusing or mixing the lubricating agents with the insulating material at a high temperature prior to cooling. Therefore, the chemical, physical, or electrical properties of the wire or cable may be preserved.

In one embodiment, the application device 110 may be a spraying device for spaying the composition of lubricating agents over the surface of the cooled and insulated wire or cable. In one embodiment, the spraying device 110 may comprise a tank for storing the composition of lubricating agents, at least one spraying nozzle for spraying the composition of lubricating materials, a pump (not shown) for delivering the composition of lubricating agents from the tank to the at least one spraying nozzle (not shown), and a valve (not show) for controlling the pressure at which the composition of lubricating agents is applied over the wire or cable. The at least one spraying nozzle may be a circumferential spray head that applies an even coating of the composition of lubricating agents over the entire length of the cooled and insulated wire or cable. Because the composition with the lubricating agents has a low viscosity, it allows for flowing of the composition over the wire or cable surface without clogging the at least one spraying nozzle.

In an alternative embodiment, the application device 110 may be a trough bath filled with the composition of lubricating agents. In this embodiment, the cooled and insulated wire or cable is pulled through the trough-like bath to coat the surface of the cooled and insulated wire or cable with the composition of lubricating agents. The trough bath may comprise a tank for storing the composition of lubricating agents, a recirculating pump for recirculating the composition of lubricating agents, and a set of air knives at the terminal end of the trough bath to remove excess composition of lubricating agents before the wire or cable exits the bath. The trough bath provides a complete coverage of the lubricating agent over the wire or cable as the wire or cable is submerged in the bath when it is pulled through the trough.

After application device 110 applies the composition over the cooled and insulated wire or cable, a motor-driven reel 112 is provided to wind up the resulting wire or cable. The resulting wire or cable is reeled by the motor-driven reel 112 and wrapped in plastic film for distribution or storage.

Figure 2:
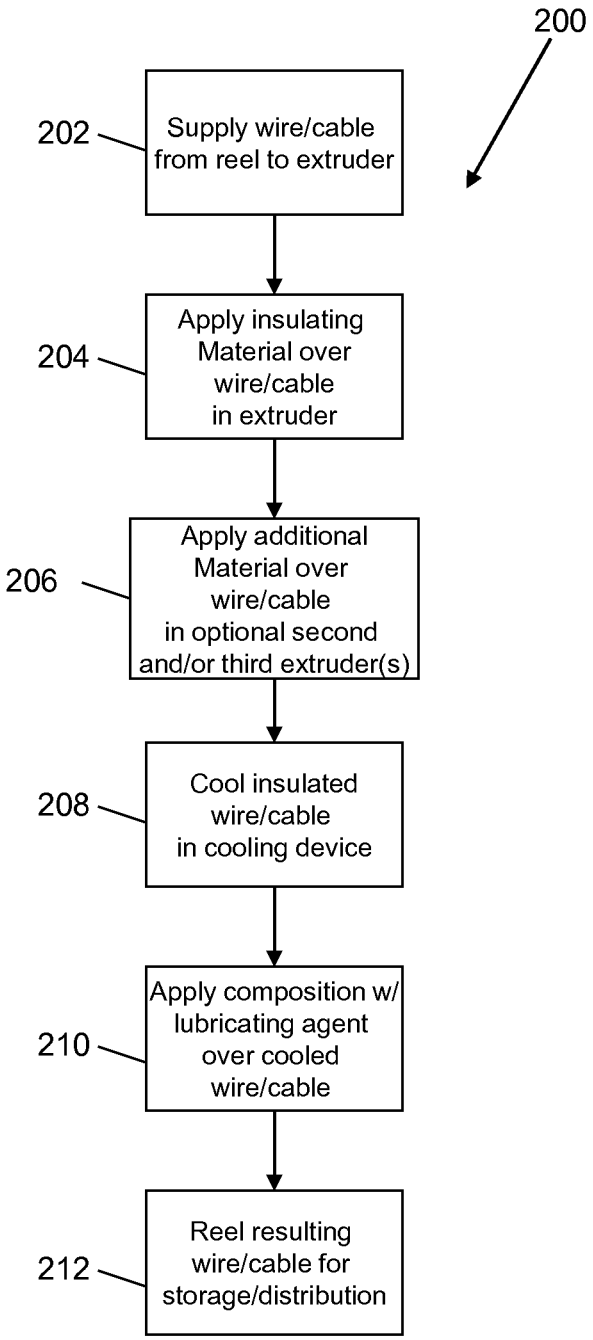
FIG. 2 is a diagram illustrating a method for reducing the coefficient of friction and required pulling force during installation of wire or cable in accordance with an embodiment of the present disclosure.

Referring to FIG. 2, a diagram illustrating a process for reducing the coefficient of friction is depicted in accordance with one embodiment of the present disclosure. Process 200 begins at step 202 to supply a conductor wire or cable from a reel to an extruder. Next, process 200 continues to step 204 to apply an insulating material over the internal conductor of the wire or cable. For example, insulating material such as PVC or PE may be applied over the internal conductor in extruder 104 of FIG. 1. Process 200 then continues to step 206 to apply additional material over the insulated wire or cable in an optional extruder. For example, additional insulating material, such as PVC or PE, may be applied over the insulated wire or cable in the first optional extruder 104 and/or the second optional 106 of FIG. 1, or any combination thereof.

Process 200 then continues to step 208 to cool the insulated wire or cable using a cooling device 108 of FIG. 1. For example, the cooling device 108 may be a water trough that cools the insulating material by removing latent heat caused by extrusion in extruder 104 or optional extruder 106. In one embodiment, the insulating material is cooled to an ambient temperature, such as a temperature of less than 85 degrees Celsius. Process 200 continues to step 210 to apply a lubricating composition with lubricating agents over the cooled wire or cable. For example, a device 110, such as a spraying device or a trough-like bath, may be used to apply a lubricating composition with lubricating agents over the cooled wire or cable. Process 200 then completes at step 212 to reel the resulting wire or cable onto a storage reel for storage or distribution. For example, a motor-driven reel may be used to reel the resulting wire or cable onto spools for storage or distribution.

It is noted that the manner in which the lubricating composition is applied by application device 110 in step 210 enables the application of the lubricating composition to be performed under various wire or cable supply speed and sizes. Even if the wire or cable is supplied at a high speed, device 110 performs application of the lubricating composition and provides complete coverage of lubricating agents over the wire or cable when the wire or cable is sprayed or submerged in the bath and pulled through the trough. In addition, the application of the lubricating composition may be performed on any size wire or cable by application device 110 in step 210. Because application device 110 applies the lubricating composition over the surface of the wire or cable instead of by impregnation, infusion or mixing, no impact is made to the chemical, physical, or electrical properties of the wire or cable.

In one embodiment of the present disclosure, the lubricating composition is an environmentally friendly, solvent-free, halogen-free, water based colloidal emulsion. The viscosity of the lubricating composition enables various types of application, including spraying and coating by a bath and reduces flowing and dripping of the composition after it is applied on the wire or cable. As a result, damage to the machine or equipment is minimized during the manufacturing process.

In one embodiment of the present disclosure, the lubricating composition comprises a number of materials including, but not limited to, polytetrafluoroethylene, distilled (DI) water, polyethylene glycol (PEG), an optional potassium neutralized vegetable fatty acid, an optional paraffin wax emulsion, polydimethylsiloxane (PDMS) emulsion, an optional polyacrylamide polymer, a potassium salt of polyacrylic acid polymer, and a silicone-based antifoaming agent.

In this lubricating composition, the lubricating agents include PEG, an optional potassium neutralized vegetable fatty acid, an optional paraffin wax emulsion, and PDMS emulsion. The PEG and PDMS emulsion provides a reduction of coefficient of friction of the surface insulating material such as polythethylene (PE) and PVC. In particular, PEG is most effective with a molecular weight of about 50 to 800 and the PDMS is most effective with a viscosity of between about 1000 CST and about 20000 CST.

The optional polyacrylamide polymer and the optional potassium salt of polyacrylic acid polymer are used for rheology modification and emulsion stabilization. The silicone-based antifoaming agent are used as a processing aid. The optional polyacrylamide polymer provides the composition the ability to stay on the surface of the wire or cable without causing damages to the machine or equipment during the manufacturing process because of clogging. This component is a fluocculant that increases the wetting character and may bring lubricating agents to the surface. The potassium salt of polyacrylic acid polymer provides viscosity and coating thickness and stabilizes the emulsion of lubricating agents.

The optional potassium neutralized vegetable fatty acid provides a lower coefficient of friction in insulating materials, such as PVC, rubberized plastics, steel and wood. This component also provides wetting character to the lubricating composition. The optional paraffin wax emulsion provides a lower coefficient of friction on outer jacket material, such as Nylon.

In one embodiment of the present disclosure, the lubricating composition is composed of 85 percent or above distilled (DI) water, with about five percent or less of polyethylene glycol (PEG), potassium neutralized vegetable fatty acid, paraffin wax emulsion, and polydimethylsiloxane (PDMS) emulsion; and about 0.25 or less percent of polyacrylamide polymer, a potassium salt of polyacrylic acid polymer, and a silicone-based antifoaming agent.

For example, the lubricating composition may comprise polytetrafluoroethylene; about 85 to 95 percent DI water; about 0.5 to about 5 percent PEG; about 0.5 to about 5 percent potassium neutralized vegetable fatty acid; about 0.5 to about 5 percent paraffin wax emulsion; about 0.5 to about 5 percent polydimethylsiloxane (PDMS) emulsion; about 0.01 to about 0.10 percent of polyacrylamide polymer, about 0.08 to about 0.25 percent of potassium salt of polyacrylic acid polymer; and about 0.01 to about 0.25 percent of silicone-based antifoaming agent.

In another example, the lubricating composition may comprise polytetrafluoroethylene; about 93.20 percent DI water, about 1.38 percent polyethylene glycol, about 1.29 percent potassium neutralized vegetable fatty acid, about 1.99 percent paraffin wax emulsion, about 1.88 percent polydimethylsiloxane (PDMS) emulsion, about 0.01 percent polyacrylamide polymer, about 0.08 percent potassium salt of polyacrylic acid polymer, and about 0.16 percent silicone-based antifoaming agent.

The combination of these materials in the lubricating composition provides a reduction in the coefficient of friction of the wire or cable surface when the wire or cable is pulled through a conduit. It also provides a thin coating spread evenly over the wire or cable surface, remains available on the wire or cable surface throughout the pull, and continues to lubricate the wire or cable surface even after it is dried. Furthermore, the lubricating composition is compatible with many different types of wire or cable, which provides for many different applications.

Figure 3:
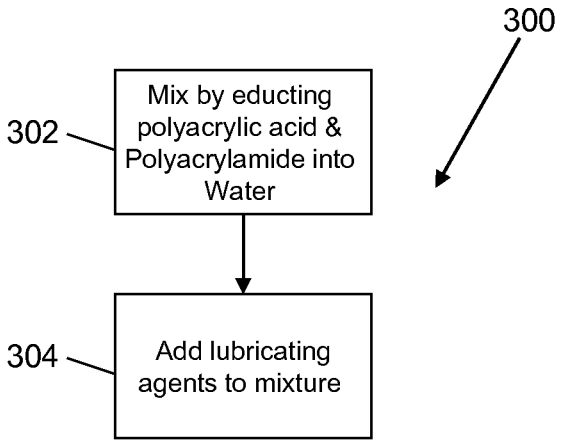
FIG. 3 is a diagram illustrating a process for forming a composition for reducing the coefficient of friction and the required pulling force during installation of wire or cable in accordance with an embodiment of the present disclosure.

Referring to FIG. 3, a diagram illustrating a process for forming a lubricating composition for reduction of coefficient of friction of a wire or cable is depicted in accordance with one embodiment of the present disclosure. Process 300 may be performed prior to step 210 in FIG. 2 in which the composition is applied over the cooled wire or cable. In this embodiment, process 300 begins at step 302 to mix by educting the potassium salt of polyacrylic acid polymer and polyacrylamide polymer into DI water to form a mixture. Next, process 300 completes at step 304 to add lubricating agents into the mixture to form the composition. In one embodiment, the lubricating agents include PEG, an optional potassium neutralized vegetable fatty acid, an optional paraffin wax emulsion, and PDMS emulsion. The lubricating agents provides a lower coefficient of friction to the wire or cable surface when the lubricating composition is subsequently applied.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed is:

1. An electrical cable with a reduced coefficient of friction and reduced pulling force during installation for delivery on a reel, the electrical cable comprising:
- at least one conductor wire;
- an insulating material composition over the at least one conductor wire, wherein the insulating material is cooled after application to the conductor wire;
- a lubricating composition applied to the insulating material subsequent to the cooling of the insulating material and prior to winding of the electrical cable on a reel, the lubricating composition comprising:
  - distilled (DI) water;
  - polyethylene glycol (PEG);
  - polydimethylsiloxane (PDMS) emulsion;
  - silicone-based antifoaming agent; and
  - paraffin wax emulsion.

2. The electrical cable of claim 1, wherein the distilled (DI) water is at least 85 weight % based on the total weight.

3. The electrical cable of claim 2, wherein the polyethylene glycol (PEG) is no more than 5 weight % based on the total weight.

4. The electrical cable of claim 1 further comprising polyacrylamide polymer.

5. The electrical cable of claim 1 further comprising potassium neutralized vegetable fatty acid.

6. The electrical cable of claim 1 further comprising potassium salt of polyacrylic acid polymer.

7. The electrical cable of claim 6 further comprising polyacrylamide polymer.

8. The electrical cable of claim 7, wherein the polyacrylamide polymer, potassium salt of polyacrylic acid polymer, and silicone-based antifoaming agent combined are no more than 0.25 weight % based on the total weight.

9. The electrical cable of claim 7 further comprising potassium neutralized vegetable fatty acid.

10. The electrical cable of claim 5, wherein the polyethylene glycol (PEG), potassium neutralized vegetable fatty acid, paraffin wax emulsion, and polydimethylsiloxane (PDMS) emulsion are no more than 5 weight % based on the total weight.

11. The electrical cable of claim 1 further comprising polytetrafluoroethylene.

12. The electrical cable of claim 1, wherein the insulating material is a thermoplastic material.

13. The electrical cable of claim 1, wherein the lubricating composition is applied to the insulating material by a spraying device.

14. The electrical cable of claim 1, wherein the lubricating composition is applied to the insulating material by a trough bath.

15. An electrical cable with a reduced coefficient of friction and reduced pulling force during installation, the electrical cable comprising:
- at least one conductor wire;
- an insulating material composition over the at least one conductor wire;
- a jacket over the insulating material, wherein the insulating material and the jacket are cooled after application to the conductor wire;
- a lubricating composition applied to the jacket subsequent to the cooling of the insulating material and prior to winding of the electrical cable on a reel, the lubricating composition comprising:
  - distilled (DI) water;
  - polyethylene glycol (PEG);
  - polydimethylsiloxane (PDMS) emulsion;
  - silicone-based antifoaming agent; and
  - paraffin wax emulsion.

16. The electrical cable of claim 15, wherein the jacket is formed from a nylon material.

17. The electrical cable of 15, wherein the at least one conductor wire is an at least one copper wire.

18. The electrical cable of 17, wherein the at least one copper wire is an at least two copper wires.

19. The electrical cable of 15, wherein the at least one conductor wire is an at least one aluminum wire.

20. The electrical cable of 19, wherein the at least one aluminum wire is an at least two aluminum wires.

* * * * *